US011910824B2

(12) United States Patent
Yang

(10) Patent No.: US 11,910,824 B2
(45) Date of Patent: Feb. 27, 2024

(54) CIGARETTE BUTT WRAPPING PAPER

(71) Applicant: Jun Ho Yang, Seoul (KR)

(72) Inventor: Jun Ho Yang, Seoul (KR)

( * ) Notice: Subject to any disclaimer, the term of this patent is extended or adjusted under 35 U.S.C. 154(b) by 264 days.

(21) Appl. No.: 17/267,597

(22) PCT Filed: Aug. 13, 2018

(86) PCT No.: PCT/KR2018/009296
§ 371 (c)(1),
(2) Date: Feb. 10, 2021

(87) PCT Pub. No.: WO2020/036236
PCT Pub. Date: Feb. 20, 2020

(65) Prior Publication Data

US 2021/0315271 A1 Oct. 14, 2021

(30) Foreign Application Priority Data

Aug. 12, 2018 (KR) ..... 10-2018-0094113

(51) Int. Cl.
*A24F 19/00* (2006.01)
*A24F 19/14* (2006.01)
(Continued)

(52) U.S. Cl.
CPC ..... *A24F 19/0028* (2013.01); *A24F 19/0064* (2013.01); *A24F 19/14* (2013.01);
(Continued)

(58) Field of Classification Search
CPC ..... A24F 13/18; A24F 15/18; A24F 19/00; A24F 19/0028; A24F 19/0064;
(Continued)

(56) References Cited

U.S. PATENT DOCUMENTS 6,990,983 B1 * 1/2006 Lyman, Jr. ..... A24F 19/0064 131/241
2008/0121243 A1 * 5/2008 Galoyan ..... A24F 15/18 131/231
(Continued)

FOREIGN PATENT DOCUMENTS

JP 3036459 U 4/1997
JP 2006314210 A * 11/2006
(Continued)

OTHER PUBLICATIONS

International Search Report from corresponding PCT Application No. PCT/KR2018/009296, dated May 8, 2019.

*Primary Examiner* — Bryon P Gehman
(74) *Attorney, Agent, or Firm* — Harness, Dickey & Pierce, P.L.C.

(57) ABSTRACT

The present invention relates to a cigarette butt wrapping paper which comprises: a body having a planar shape approximately similar to the shape of a cigarette pack; a flame-retardant coated surface which is formed on the inside of the body, has a transverse length approximately similar to the circumferential length of a cigarette butt, and is coated with a material having a heat resisting function; an adhesive applied surface onto which an adhesive has been applied, wherein the adhesive applied surface is an area surrounding the outer circumferential surface of the flame-retardant coated surface; and opening forming parts which are formed in such a manner that the opposite side ends of the lower end of the body are inwardly recessed and form an entrance, through which the cigarette butt can be input, when the opposite side ends are matched and boned to each other.

6 Claims, 4 Drawing Sheets

(51) Int. Cl.

| | |
|---|---|
| ***B65D 65/12*** | (2006.01) |
| ***B65D 65/14*** | (2006.01) |
| ***B65D 65/42*** | (2006.01) |
| ***B65D 85/10*** | (2006.01) |
| ***D21H 21/34*** | (2006.01) |
| ***D21H 19/68*** | (2006.01) |
| ***D21H 19/84*** | (2006.01) |

(52) U.S. Cl.
CPC ..... *B65D 65/12* (2013.01); *B65D 65/14* (2013.01); *B65D 65/42* (2013.01); *B65D 85/1081* (2013.01); *D21H 19/68* (2013.01); *D21H 19/84* (2013.01); *D21H 21/34* (2013.01)

(58) Field of Classification Search
CPC ..... A24F 19/14; A24F 47/00; B65D 65/12; B65D 65/14; B65D 65/42; B65D 75/10; B65D 75/58; B65D 81/36; B65D 85/10; B65D 85/1081; D21H 15/68; D21H 15/84; D21H 21/34
See application file for complete search history.

(56) References Cited

U.S. PATENT DOCUMENTS

| | | | | |
|---|---|---|---|---|
| 2018/0014569 | A1* | 1/2018 | Chagas Faresin .. | A24F 19/0064 |
| 2018/0070631 | A1* | 3/2018 | Reynolds ..... | A24F 19/10 |

FOREIGN PATENT DOCUMENTS

| | | | |
|---|---|---|---|
| JP | 3173254 | U | 2/2012 |
| KR | 20-0345595 | Y1 | 3/2004 |
| KR | 10-2017-0088837 | A | 8/2017 |
| KR | 10-2018-0001988 | A | 1/2018 |

* cited by examiner

CIGARETTE BUTT WRAPPING PAPER

CROSS REFERENCE TO RELATED APPLICATIONS

This application is a national phase application of PCT Application No. PCT/KR2018/009296, filed on 13 Aug. 2018, which claims the benefit of and priority to Korean Patent Application No. 10-2018-0094113, filed 12 Aug. 2018. The entire disclosures of the applications identified in this paragraph are incorporated herein by references.

FIELD

The present invention relates to a cigarette butt wrapping paper.

BACKGROUND

The present invention relates to a cigarette butt wrapping paper for receiving a single or all cigarette butts to be discarded. As smoking cessation culture becomes widespread, negative public opinions about smoking also become widespread, the number of smoking spaces has been rapidly reduced. Therefore, smokers frequently need to continuously face further poorer environments to smoke. In many places under such a poor environment, there is a lack of facilities for disposing of cigarette butts, thereby causing dumping of cigarette butts. Accordingly, due to dumping of cigarette butts, the perception of smokers and smoking has been getting worse.

On the other hand, in terms of such a poor smoking environment, although the society and tobacco sellers are responsible for providing a sound smoking environment, they have taken no measure while shifting all of the responsibilities to smokers. Therefore, since an issue of disposing of cigarette butts in a convenient and eco-friendly manner has been regarded as a problem only for individual smokers, it is necessary for individual smokers to select a smoking place in which they can flip ash off their cigarettes and dispose of cigarette butts, or to use a portable ashtray.

Cigarette butts not only contain about 20 kinds of harmful substances and plastic chemicals, but also are lumps of various chemical substances in case of being left after burning. Therefore, if cigarette butts were discarded as they are, they could be serious threats to the environment. There is also a study showing that there are 5 trillion cigarette butts, which are discarded while containing harmful substances and chemicals, per year around the world. It is said that the budget of USD 3 to 16 million is spent to clean up the huge number of cigarette butts in one city.

In addition, cigarette butts sometimes include embers. Therefore, if cigarette butts are dumped as they are, there is always a possibility that a fire occurs due to the embers of the cigarette butts.

However, portable ashtrays, which have been currently used, cannot be a practical alternative. In this regard, "a small box for collecting cigarette butts" has ever been disclosed in Korean Patent Application No. 10-2010-0002132. It's not easy to always use such a hard case-type portable ashtray because it is inconvenient to carry the portable ashtray separately. There is a contradiction that such a portable ashtray not only needs a large size for storage capacity, but also needs a small volume for convenience of portability. For this reason, the portable ashtray can receive only about 4 cigarette butts on average. Therefore, the portable ashtray cannot be used again until the received ash and cigarette butts are thrown away somewhere. In particular, there is a reality that hard case-type portable ashtrays have been turned away because most of them are expensive and have a large volume.

In addition, a portable ashtray called Tick, which has the shape of a plastic pouch filled with air, has been currently used, and it is cheaper and lighter to be easily carried. However, due to the above-mentioned disadvantages, portable ashtrays are discarded together with cigarette butts after used just once, rather than recycled several times, thereby causing a current situation that the amount of garbage rather increases.

In order to solve this problem, the objective of the present invention is to present a method of safely and cleanly disposing of cigarette butts, rather than a function of tapping ash.

To sum up, compared to a tabletop ashtray, the existing portable ashtray has a difference in its smaller size to reinforce only portability. That is, the concept of the existing portable ashtray has failed to overcome the stereotype of a desktop ashtray. The portable ashtray has a crucial disadvantage that the smaller its size is, the more often cigarette butts need to be thrown away. For this reason, there is a limit in achieving the purpose of preventing the dumping of cigarette butts.

However, there is a clue to solve the problem. Currently, some smokers also use their cigarette packs as ashtrays. If there is no surrounding environment where they can discard cigarette butts safely and cleanly, they would rather store cigarette butts, which have been completely smoked, in their cigarette packs so as to care the environment and other persons. Then, the cigarette butts received in the cigarette packs are thrown away together with the cigarette pack into a trash. In other words, if smokers used their carriable cigarette packs as ashtrays, the problem could be solved. However, this method also comes with inconvenience and risk nowadays. Because it is necessary to remove cigarette embers (so-called bullets) from cigarette butts before receiving the cigarette butts, flicked cigarette embers may cause a risk of a fire and an accident. Moreover, if individual cigarettes, which have not been smoked yet, and cigarette butts are stored together, odors from the cigarette butts pervade the cigarettes, thereby decreasing smoker's smoking satisfaction when the smoker smokes the cigarettes that have been stored together with the cigarette butts.

Therefore, if there was a cigarette butt discarding method of safely treating cigarette butts even with embers, cleanly disposing of ashes and cigarette butts, and also keeping the taste of unused cigarettes, cigarette butts could be stored in a cigarette pack, not be dumped.

SUMMARY

Problem to be Solved

The present invention has been conceived to overcome the above-described problems. The objective of the present invention is to prevent cigarette butts from being dumped without permission, prevent a user from burning when collecting cigarette butts, remove odors from cigarette butts after collecting them, and prevent fire caused by cigarette butts. Another objective of the present invention is to increase a cigarette butt collection rate so as to contribute to the protection of environments and the recycling of resources.

Means for Solving the Problem

In order to achieve the above-described purposes, the present invention provides a cigarette butt wrapping paper which may comprise: a planar surface-shaped body (11) which has a shape approximately similar to that of a cigarette pack; a flame-retardant coated surface (13) which is formed on the inside of the body (11), has a transverse length approximately similar to the circumferential length of a cigarette butt, and is coated with a material having a heat-resisting function; an adhesive applied surface (12) which is an area surrounding the outer circumferential surface of the flame-retardant coated surface (13), an adhesive being applied onto the adhesive applied surface; and opening forming parts (15) which are formed in such a manner that the opposite side ends of the lower end of the body (11) are inwardly recessed and form an entrance, into which a cigarette butt can be put, when the opposite ends are matched and bonded to each other.

A left first adhesive part (A) and a right first adhesive part (B) are formed around the flame-retardant coated surface (13). The left first adhesive part (A) and the right first adhesive part (B) are butted against each other and bonded to each other so that the flame-retardant coated surface (13) is rolled up so as to form a space for receiving a cigarette butt therein.

An upper end first adhesive part (C) is formed on the upper end of the flame-retardant coated surface (13) and can be rolled up or bonded together to seal the upper end part.

In order to easily separate the wrapping paper, the cigarette butt wrapping paper may further comprise a sheet separation part (16) onto which an adhesive has not been applied.

The cigarette butt wrapping paper may further comprise a finishing sleeve (14) which is formed on one vertical side end of the body (11) in a shape asymmetrical to that of the other end opposite thereto to be positioned on the side surface of one of the left first adhesive part (A) and the right first adhesive part (B), wherein when the corresponding end is butted against and bonded to the other end, the finishing sleeve (14) is not bonded to be left so that the body is rolled up in a cylindrical shape.

A thermosensitive ink applied part (17) may be formed on the outer surface of the body (11), wherein the thermosensitive ink applied part (17) has color which is changed when the embers of a cigarette butt come into contact therewith.

A seal-coated surface (18) may be formed on an area of the wrapping paper, which is sized to completely surround a cigarette butt while entirely or partially overlapping the flame-retardant coated surface (13), to block odors by preventing air permeation.

A guide line, which has been previously pressed along the line through scoring work to be conveniently folded, may be formed on the boundary surface between the flame-retardant coated surface (13) and the finishing sleeve (14).

Each center part of the upper and lower ends of the body (11) and one side surface of the flame-retardant coated surface (13) have been obliquely scored, and the score-starting portions, which have been first scored, may be cut into the shape of a half-moon through a Thomson work.

With the purpose of overlapping several sheets of paper in an unfolded planar state with each other, the cigarette butt wrapping paper may have an outer surface onto which a peeling process has been performed.

Two or more cigarette butt wrapping papers according to the present invention may form a larger reception space by being butted against to each other.

The cigarette butt wrapping paper in an unfolded planar shape may be bonded to an object including a cigarette pack (or a wallet and a notebook) to be carried.

Effects of the Invention

As described above, a cigarette butt wrapping paper can be attached to a cigarette pack to be carried without being separately carried. Therefore, there is an effect that smokers can use the cigarette butt wrapping paper conveniently.

As described above, a cigarette butt wrapping paper is carried along with a cigarette pack to easily and safely receive a cigarette butt that has been just smoked, so as to prevent the cigarette butt from being dumped individually. Therefore, there is an effect that cigarette butts can be discarded all at once together with the cigarette pack later.

In addition, the present invention presents a method of safely and cleanly disposing of a cigarette butt and thus has an effect of preventing fire caused by the embers of cigarette butts and environmental pollution caused by harmful substances and chemicals in cigarette butts dumped without permission.

DETAILED DESCRIPTION

Figure 1:
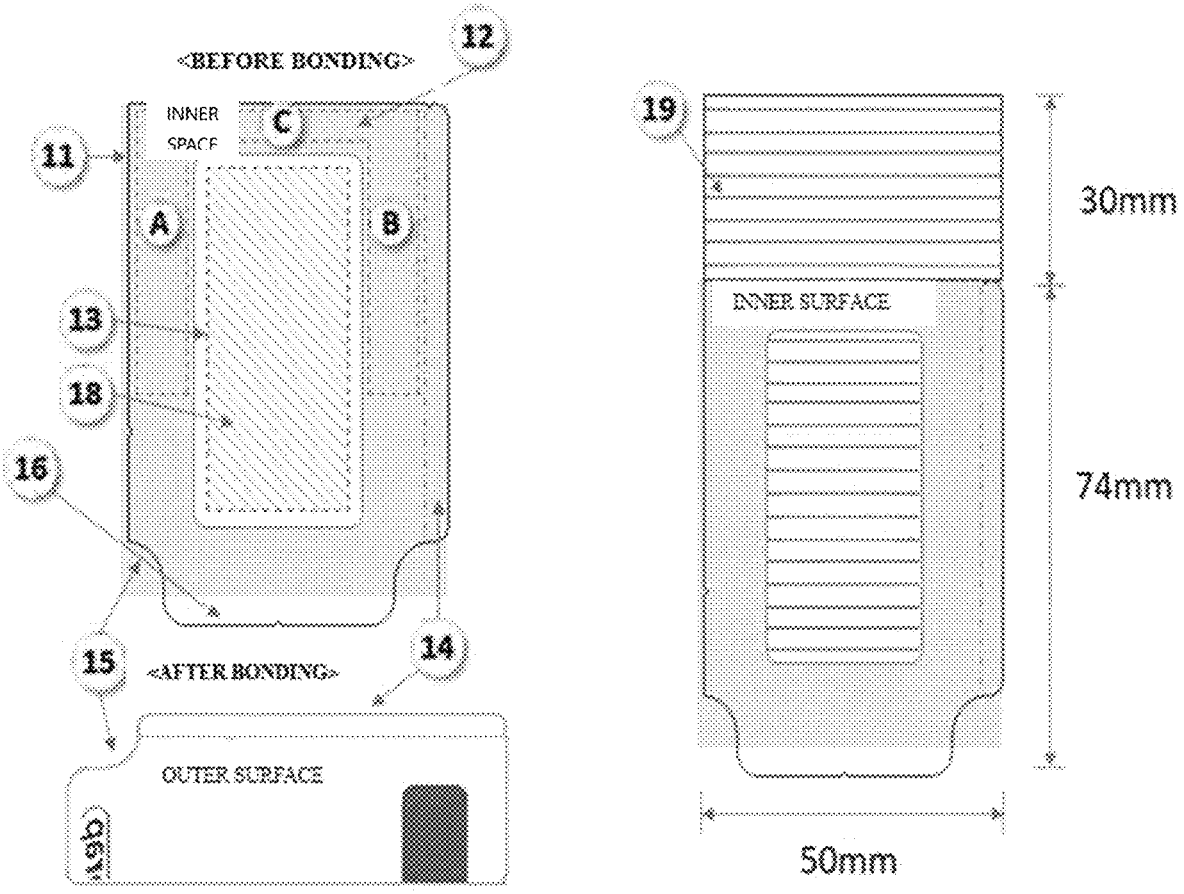
FIG. 1 is a drawing showing an embodiment according to the present invention.

Hereinafter, the present invention is described in detail with reference to the accompanying drawings. FIG. 1 shows the inner surface of a cigarette butt wrapping paper according to an embodiment of the present invention. The cigarette butt wrapping paper according to the present invention includes an adhesive applied surface (12) formed inside the inner surface of the body (11).

An adhesive is used for stacking a plurality of cigarette butt wrapping papers according to the present invention on one another and attaching the cigarette butt wrapping papers onto the outer surface of a cigarette pack. As such, an additional attachment mean may be included to attach the cigarette butt wrapping papers onto the outer surface of the cigarette pack, so that each of the cigarette butt wrapping papers includes an adhesive applied surface (12) on the inner surface thereof to be attached in the same method as that of Post-it. According to such a configuration, the cigarette butt wrapping papers are attached to the outer surface of the cigarette pack and, as necessary, are detached therefrom one by one to be used.

In addition, an adhesive is applied onto the entire surface of the body from the inner surface to the outside of a flame-retardant coated surface (13), and the adhesive also plays a role of bonding the inner surfaces of the body to each other when the body (11) is rolled up to receive a cigarette butt therein. (The adhesive applied surface (12) is the portion marked in gray on the drawing, and an adhesive has been applied onto the adhesive applied surface (12). Because multiple cigarette butt wrapping papers are attached to the cigarette pack by the adhesive before being rolled up, it is possible to detach the single cigarette butt wrapping paper from the cigarette pack and then easily roll up the cigarette butt wrapping paper into a small envelope-shape).

An adhesive is not applied onto the flame-retardant coated surface (13). A coating agent may be also entirely applied onto the flame-retardant coated surface (13), and the coating agent may be also applied in the shape of a pattern with several stripes or a grid pattern. In a case that a coating agent is printed or applied onto the paper, because the body (11) can be crumpled or wrinkled when the flame-retardant coated surface (13) is entirely coated, the coating agent can be applied in the shape of a grid pattern or a striped pattern.

Specifically, when using a cigarette butt wrapping paper including a left first adhesive part (A) and a right first adhesive part (B) formed on both sides of a flame-retardant coated surface (13) thereof, the left first adhesive part (A) and the right first adhesive part (B) come into contact with each other so that the flame-retardant coated surface (13) is rolled up in a cylindrical shape. An upper end first adhesive part (C) is formed on the upper end of the flame-retardant coated surface (13) to form a first adhesive part having the entire shape of a Korean letter "E".

Moreover, a finishing sleeve (14) is vertically formed on one side of the left first adhesive part (A) or the right first adhesive part (B) on the inner surface of the body (11). When the flame-retardant coated surface (13) is rolled up in a cylindrical shape, the finishing sleeve (14) is left.

It is possible to bond the left first adhesive part (A) and the right first adhesive part (B) to each other while leaving the portion of the finishing sleeve (14), and it is also possible to bond the opposite side ends to each other without leaving the finishing sleeve (14). However, if bonding is performed while leaving the portion of the finishing sleeve (14) after marking the portion of the finishing sleeve (14) on the inner surface or the outer surface so as to allow the only finishing sleeve portion to be recognized, it is possible to perform bonding once again after a cigarette butt is received and then sealed. Therefore, the volume of the cigarette butt wrapping paper can be reduced, and a risk of fire can be also reduced.

As shown in the drawing, the left first adhesive part (A) and the right first adhesive part (B) are bonded to each other while leaving the finishing sleeve (14). An adhesive has been applied even onto the entire finishing sleeve (14) so that, when the cigarette butt wrapping paper, which has been first folded into an envelope-shape, receives a cigarette butt therein, is folded once more, and then is sealed, the entire finishing sleeve (14) is bonded, thereby achieving finishing.

Although each person may form a different folded shape, the left first adhesive part (A) and the right first adhesive part (B) are first folded, or the upper end first adhesive part (C) is first folded to form a space into which a cigarette butt can be put. The space is sealed after receiving a cigarette butt therein, and the finishing sleeve (14) is then rolled up once more, so that the space can be completely sealed.

A flame-retardant coated surface (13) is formed on the center of the inner surface of the body (11). The flame-retardant coated surface (13) is coated to be flame-retardant so that the body does not burn even if a cigarette butt with embers is put into the body. As resistance to flame is achieved, air permeability is lowered. Therefore, when the body (11) is sealed after receiving a cigarette butt therein, the embers of the cigarette butt can be extinguished, and the odors from the cigarette butt can be blocked. In addition, when the flame-retardant coated surface (13) has a transverse length of about 26 mm, so that when the flame-retardant coated surface (13) is rolled up to have a circumference similar to the circumference (8 mm) of one typical cigarette, the flame-retardant coated surface (13) is sealed by the adhesive applied surface while completely surrounding the cigarette, which allows the embers of the cigarette butt to be completely extinguished. Therefore, thanks to its flame-retardant function, fire/burns can be prevented, and the odor generated from the cigarette can be blocked.

The flame-retardant coated surface (13) has a longer length in the vertical direction to allow a longer cigarette butt to be input, and the finishing sleeve (14) is also formed in the vertical direction. Therefore, the body (11) is induced to be rolled up in the vertical direction, so that when the body (11) is folded after receiving a cigarette butt therein, the body is formed in the same size and shape as those of one cigarette so as to be put into the cigarette pack again. Moreover, the adhesive applied surface (12) strongly adheres to itself while the flame-retardant coated surface (13) without an adhesive does not adhere to itself, so that the wrapping paper is rolled up into a cylindrical shape like a tunnel, thereby forming a space which can receive a cigarette butt therein.

Separately from flame-retardant coating, seal coating for sealing may be performed to the flame-retardant coated surface (13). Flame-retardant coating may have a function of seal coating, but since flame-retardant coating and seal coating are typically distinguished from each other, therefore, separately from flame-retardant coating, seal coating is performed to form a seal-coated surface (18).

The seal coating is performed to prevent dust or odors generated from the cigarette butts in the body (11) from being discharged to the outside. The flame-retardant coated surface (13) and the seal-coated surface (18) may nearly correspond to each other, but may have a slight difference from each other in their sizes as necessary.

The flame-retardant coated surface (13) may be also coated in the shape of a striped pattern, and flame-retardant coating has been formed on an attachment part (19) in the shape of a striped pattern. Therefore, it is possible to detach the attachment part (19) and then attach the attachment part (19) to the flame-retardant coated surface so as to be used. At this time, while the flame-retardant coating in the shape of a striped pattern forms a cross-shape, the entire flame-retardant coated surface (13) is formed in a closed shape. Also, two sheets of paper are attached to the flame-retardant coated surface (13) so that the flame-retardant coating has an effect similar to that of a case in which flame-retardant coating has been performed to the entire flame-retardant coated surface (13).

A risk of fire due to the embers of a cigarette butt is remarkably reduced just through the attachment of one sheet of paper, and even if the embers burn a part of the inner surface, the embers cannot get bigger in an enclosed space so that the embers burn using the air remaining in the space and is then extinguished.

The portion near the striped coating line of the flame-retardant coated surface has been scored, so that air can exists in the inner scored portion. Therefore, when a cigarette butt is input, a final ignition can occur once in the attachment part (19). Through this final ignition, the inner air is completely consumed, thereby reducing a threat of fire due to embers.

The attachment part (19) has a size somewhat larger than the size of the flame-retardant coated surface (13) so that the attachment part (19) can be bonded by an adhesive applied around the flame-retardant coated surface (13).

The opening forming parts (15) are formed in such a manner that the opposite side ends of the lower end of the body (11) are slightly recessed toward the inside. In order to receive a cigarette butt through the opening forming parts (15), the left first adhesive part (A) and the right first adhesive part (B) formed on the body (11) are bonded to each other, thereby achieving first bonding. An adhesive has been applied above the flame-retardant coated surface (13) so that as the wrapping paper is rolled up by bonding the left first adhesive part (A) and the right first adhesive part (B) to each other, the upper end first adhesive part (C) is rolled up together, thereby sealing the upper side of the body. In addition, since the lower ends of the left first adhesive part (A) and the right first adhesive part (B) are positioned higher than the lower end of the flame-retardant coated surface (13), an opening, into which a cigarette butt can be put, is formed through the lower end part by the opening forming parts (15) formed on both sides of the lower end of the body, so that a cigarette butt is pushed to be put into the hole formed by the opening forming parts (15). When the opening forming parts (15) are pressed after the cigarette butt has been pushed and put into the opening, the opening forming parts (15) are bonded to each other by the applied adhesive, thereby achieving sealing.

That is, the left first adhesive part (A) and the right first adhesive part (B) of the body (11) are first bonded to each other in the vertical direction, and after a cigarette butt is put into the opening, the transverse side of the body, through which the opening is formed, is bonded so that the body is shaped like a closed cylindrical envelope and has a size slightly smaller than the size of one cigarette. Therefore, the received cigarette butt can be stored in the existing cigarette pack while being sealed so that there is no effect on the cigarettes that have not yet been smoked. Moreover, since only cigarette butts are left in the cigarette pack after all of the cigarettes in the cigarette pack have been smoked, it is possible to cleanly dispose of the cigarette butts all at once by discarding the cigarette pack at once.

When the left first adhesive part (A) and the right first adhesive part (B) are bonded to each other, the left first adhesive part (A) and the right first adhesive part (B) can be used as a grip for holding the cigarette butt wrapping paper, and other portion of the adhesive applied surface (12) can be also used as a grip.

The body (11) includes a sheet separation part (16) formed on the lowest end thereof, an adhesive being not applied onto the sheet separation part (16). The sheet separation part (16) is used to easily detach, one by one, the cigarette butt wrapping papers attached to a cigarette pack, wallet, or the like. Since the inside of the adhesive portion is sealed through flame retardant coating and seal coating, a risk of burns caused by cigarette butts is also reduced.

In a case that an attachment part (19) is formed, it is illustrated that the attachment part (19) is formed on the upper end of the sheet separation part (16), but the attachment part (19) may be formed on any side of the body.

Figure 2:
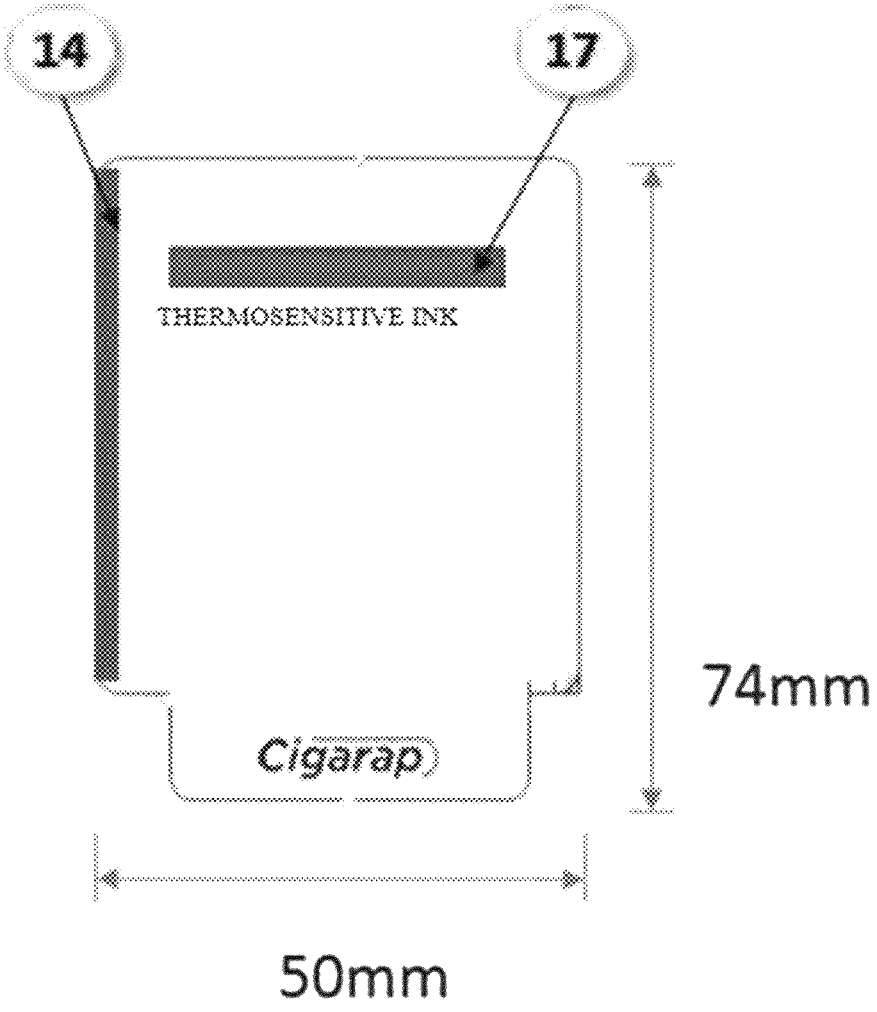
FIG. 2 is a drawing showing an embodiment according to the present invention.

FIG. 2 shows the outer surface of the body (11). A thermosensitive ink applied part (17) having thermosensitive ink applied thereto may be formed on the outer surface of the body (11). The thermosensitive ink plays a role of warning a smoker against burns due to high temperature even if there is a residual portion of the cigarette butt, the embers of which have not been extinguished yet. The thermosensitive ink, which can be changed in various colors according to various temperatures, may be used. In an embodiment according to the present invention, thermosensitive ink, which is changed in color at 45 degrees Celsius or more, is used to warn against a risk of the embers of a cigarette butt. A temperature for a change in color may vary depending on thermosensitive ink or a reference temperature for warning.

In FIG. 2, a sleeve, which is made of a material different from that of the body or has a different color, is formed on the portion of the finishing sleeve (14) in the vertical direction, so that rolling up in the vertical direction is naturally induced. As shown in FIG. 2, in a case that a differently processed sleeve is formed, an adhesive has been applied even onto the inner surface of the finishing sleeve (14) so that it is possible to roll up the sleeve portion once more to be bonded, thereby helping a smoker to wrap a cigarette butt in a cylindrical shape.

The body (11) has a size available to be attached to a cigarette pack (by coming into contact with an adhesive applied surface) and can sufficiently receive an even cigarette butt which has been somewhat smoked. However, since the embers of a cigarette butt are induced to be received in the end, the thermosensitive ink applied part (17) is formed on the upper end-side. The size of the thermosensitive ink applied part (17) shown in FIG. 2 is merely an embodiment, so the thermosensitive ink applied part can be manufactured in various sizes according to the sizes of cigarette packs used for various kinds of cigarettes.

Figure 3:
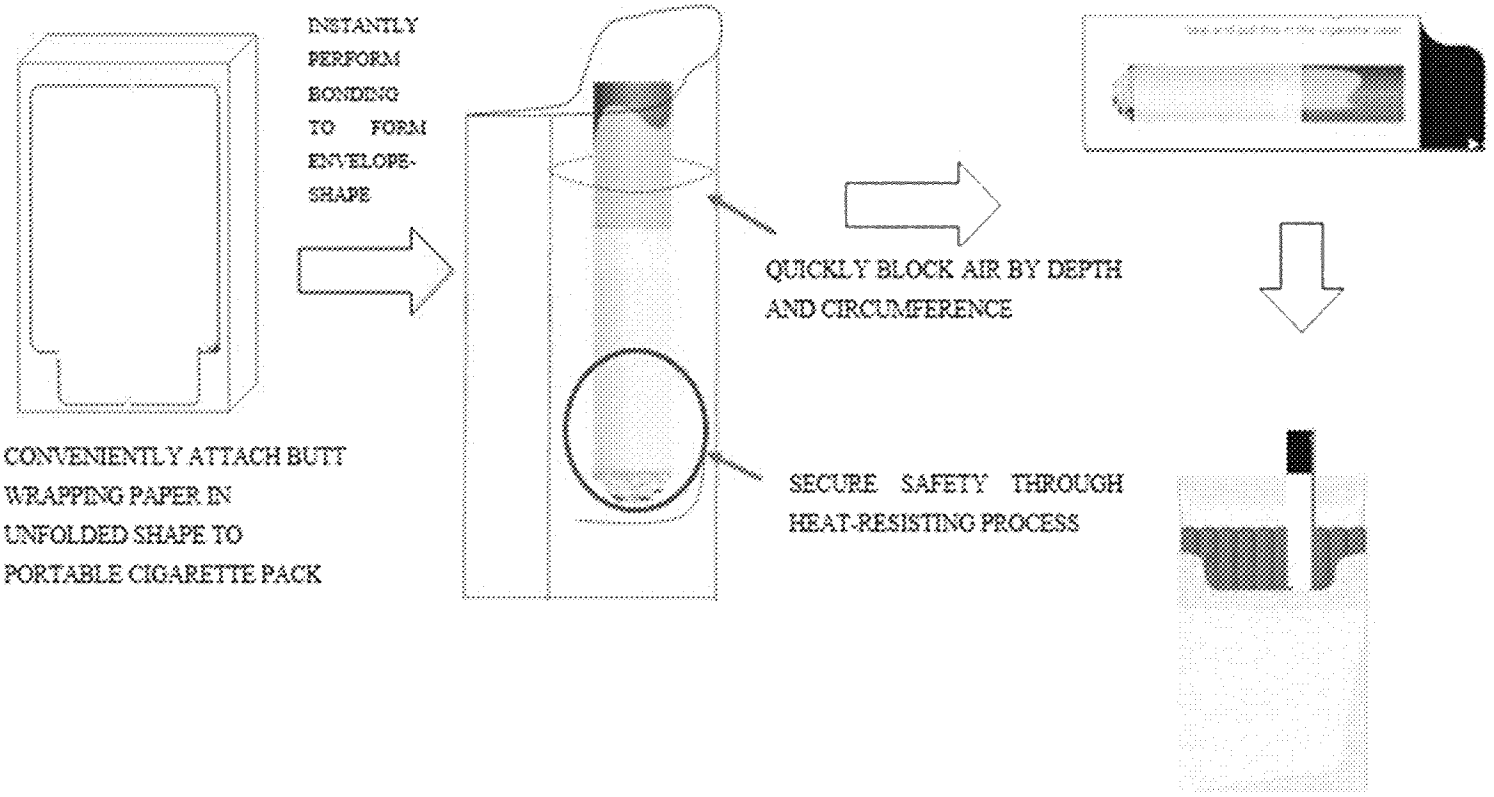
FIG. 3 is a drawing showing an embodiment according to the present invention.

FIG. 3 shows an example of the use of a cigarette butt wrapping paper according to the present invention. Although FIG. 3 illustrates a cigarette butt in a somewhat large size, when a cigarette butt is put into an envelope which has been instantly formed, and then the top of the envelope is sealed, the envelope is blocked from air so that the embers of the cigarette butt in the envelope is extinguished. Moreover, even if a smoker holds the cigarette butt from the outside, the flame-retardant processed portion prevents the smoker from getting burned.

Figure 4:
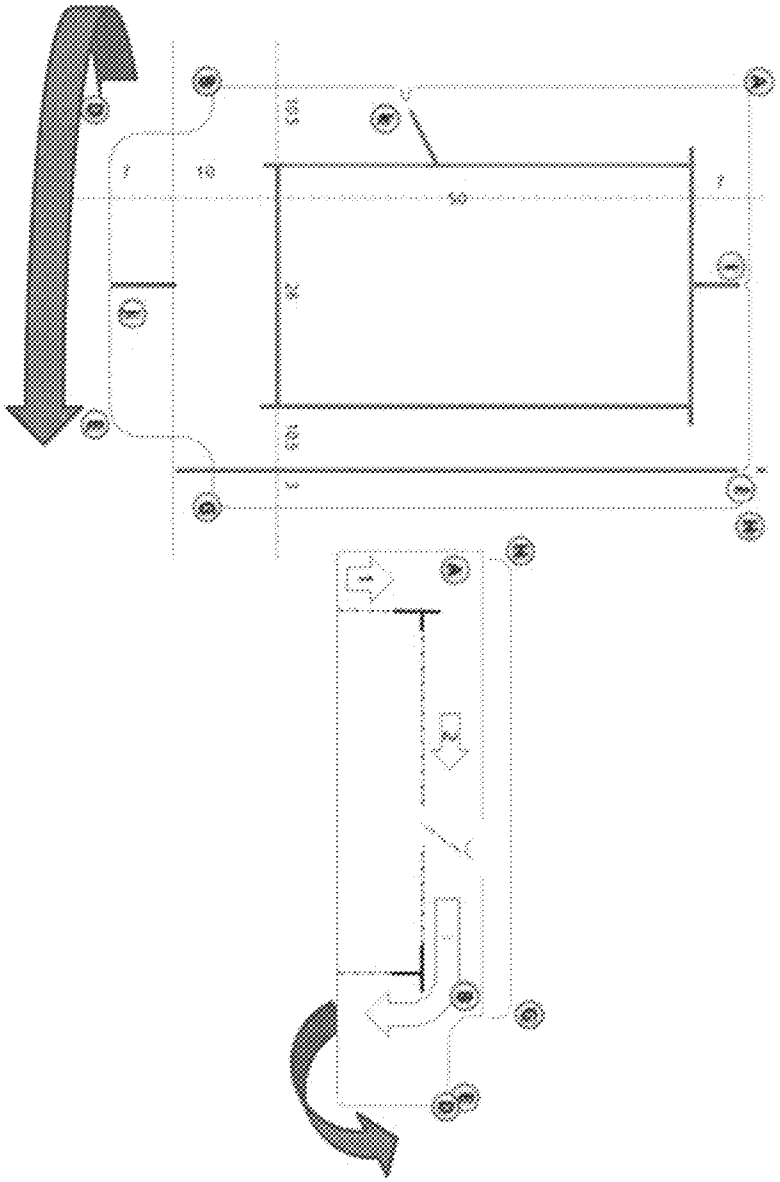
FIG. 4 is a drawing showing an embodiment according to the present invention.

FIG. 4 shows the shape of a cigarette butt wrapping paper, which has been scored by scoring work (of previously applying pressure along a specific shape or a line in order to make it easier to be folded) and has been undergone Thompson work (of cutting off a portion into the shape of a half-moon). The portions marked in blue and, specifically, the portions marked with letters i, j, k, and l have been scored. The boundary surface between the outside of the flame-retardant coated surface (13) and the finishing sleeve (14) has been scored. Also, the central portions and the side of the body have been scored. The central portions (i and j) have been scored to be easily folded when the cigarette butt wrapping paper is first folded into an envelope-shape. The scored portion (k) on the side surface of the body is obliquely formed toward the side surface of the lower end in order to allow the cigarette butt wrapping paper to be largely folded so as to easily reduce its entire size in case of small cigarette butts. Thompson work has been performed to each score-starting part of portions i and j so as to make it more convenient to be folded.

In addition, at least two cigarette butt wrapping papers according to the present invention can be butted against each other to form a larger reception space. That is, the embodiment described above is for a case that a cigarette butt wrapping paper receives one cigarette butt, is then put into and stored in a cigarette pack again, and is finally discarded together with the cigarette pack. Further, in a case that several people can collect only cigarette butts after smoking their cigarettes together and promptly discard the collected cigarette butts into a trash, a plurality of cigarette butts can be received by bonding two or more cigarette butt wrapping papers to each other. The flame-retardant coated surface (13) has a width-directional length longer than the circumferential length of a cigarette butt and has a vertical length as long as that of the cigarette. Therefore, only by bonding two cigarette butt wrapping papers to each other, four or more cigarette butts can not only be received and sealed to be thrown away in a sealed state, but also be carried to a place with a trash to be thrown away.

In particular, according to the present invention, the wrapping paper having a sealed/flame-retardant treated surface is promptly bonded to have an envelope-shape and then receives a cigarette butt therein, so that the embers of the cigarette butt can be quickly extinguished by using air (oxygen). In particular, the inner coated surface, which has undergone flame retardant treatment, completely surrounds the cigarette butt, so that the present invention has a safety function of preventing fire/burns caused by cigarette embers and an odor blocking function.

Also, the present invention has an adhesion (Post-it) function to be attached to a cigarette pack to be carried without a separate portable device. Moreover, the present invention can wrap a cigarette butt compactly, which can be received in a cigarette pack again, and thus has a function of preventing a cigarette butt from being dumped without permission.

In addition, the present invention has a process-guided design to be conveniently used by a smoker.

| EXPLANATION OF REFERENCE NUMERALS | |
|---|---|
| 11: Body | 12: Adhesive applied surface |
| 13: Flame-retardant coated surface | 14: Finishing sleeve |
| 15: Opening forming parts | 16: Sheet separation part |
| 17: Thermosensitive ink applied part | 18: Seal-coated surface |
| 19: Attachment part | |
| A: Left first adhesive part | |
| B: Right first adhesive part | |
| C: Upper end first adhesive part | |

What is claimed is:

1. A cigarette butt wrapping paper comprising:

a body having a planar shape approximately similar to the shape of a cigarette pack;

a flame-retardant coated surface formed on the inside of the body, having a transverse length approximately similar to the circumferential length of a cigarette butt, and coated with a material having a heat resisting function;

an adhesive applied surface onto which an adhesive has been applied, wherein the adhesive applied surface is an area surrounding the outer circumferential surface of the flame-retardant coated surface;

opening forming parts formed in such a manner that opposite side ends of a lower end of the body are inwardly recessed and form an entrance, when the opposite side ends are matched and bonded to each other;

a sheet separation part formed on an end of the body to allow the wrapping paper to be easily separated, wherein an adhesive has not been applied onto the sheet separation part; and a finishing sleeve which is formed on the side surface of one of the left first adhesive part and the right first adhesive part to be one vertical side end of the body, wherein when the finishing sleeve is butted against and attached to the other end of the body, the finishing sleeve is left, not bonded, so that the body is rolled up in a cylindrical shape, wherein an upper end-first adhesive part is formed on an upper end of the flame-retardant coated surface so that when the cigarette butt wrapping paper is first bonded, the upper end-first adhesive part is rolled up or bonded together so as to seal an upper end part of the flame-retardant coated surface, wherein a left first adhesive part and a right first adhesive part are formed around the flame-retardant coated surface so that the left first adhesive part and the right first adhesive part are butted against and bonded to each other so as to roll up the flame-retardant coated surface, thereby forming a space capable of receiving a cigarette butt therein, wherein a thermosensitive ink applied part is formed on the outer surface of the body and is changed in color when the embers of a cigarette butt come into contact therewith, and wherein a seal-coated surface is formed on an area enough to completely surround a cigarette butt while the seal-coated surface entirely or partially overlaps the flame-retardant coated surface, so as to prevent air penetration and thus block an odor.

2. The cigarette butt wrapping paper as claimed in claim 1, wherein a guide line, which has been scored through scoring work of previously applying pressure along the line to be easily folded, is formed on the boundary surface between the flame-retardant coated surface and the finishing sleeve.

3. The cigarette butt wrapping paper as claimed in claim 1, wherein a plurality of cigarette butt wrapping papers according to the present invention are butted against each other to form a larger reception space.

4. The cigarette butt wrapping paper as claimed in claim 3, wherein the flame-retardant coated surface have been scored in the same direction as that of the coating material coated thereon, so that in a case that a received cigarette butt has embers, final ignition occurs by a small amount of air, thereby consuming the whole amount of inner oxygen.

5. The cigarette butt wrapping paper as claimed in claim 3, wherein the cigarette butt wrapping paper in an unfolded planar shape is bonded to a cigarette pack, wallet or notebook to be carried.

6. The cigarette butt wrapping paper as claimed in claim 1, wherein the flame-retardant coated surface is coated with a flame-retardant coating material in one direction, and an attachment part formed on an upper end of the body is also coated with a flame-retardant coating material in one direction, so that the attachment part is detached and again attached to the flame-retardant coated surface to be perpendicular to the coating direction of the coating material coated on the flame-retardant coated surface, thereby surrounding a portion, into which a cigarette butt is put, by flame-retardant coating.

* * * * *